United States Patent [19]

Sawyer et al.

[11] Patent Number: 4,940,200

[45] Date of Patent: Jul. 10, 1990

[54] SUPPORT FOR A NON-SELF SUPPORTING CONTAINER

[75] Inventors: W. David Sawyer; Mark W. Sawyer, both of Indianapolis, Ind.

[73] Assignee: Wilmarc, Inc., Indianapolis, Ind.

[21] Appl. No.: 296,623

[22] Filed: Jan. 13, 1989

[51] Int. Cl.[5] ..... A63B 55/04

[52] U.S. Cl. ..... 248/97; 229/108; 248/99

[58] Field of Search ..... 248/95, 97, 98, 99, 248/100, 101, 174; 220/1 T; 229/110, 109, 108

[56] References Cited

U.S. PATENT DOCUMENTS

| | | | |
|---|---|---|---|
| 3,000,546 | 9/1961 | Catri | 248/174 |
| 3,726,469 | 4/1973 | Koehler | 229/110 X |
| 4,037,778 | 7/1977 | Boyle | 248/99 |
| 4,281,813 | 8/1981 | Garrity | 248/97 |
| 4,299,365 | 11/1981 | Battle | 248/99 |
| 4,457,483 | 7/1984 | Gange | 248/97 |
| 4,749,011 | 6/1988 | Rylander | 248/99 X |
| 4,760,982 | 8/1988 | Cooke | 248/99 |

OTHER PUBLICATIONS

Wilmarc, Inc. EASYBAGGER ® Trash Bag Support (pictures and description), Indianapolis, Indiana.

North States Trash & Lawn Bagger (pictures and description), North States Industries, Minneapolis, Minnesota.

*Primary Examiner*—David L. Talbott

*Attorney, Agent, or Firm*—E. Victor Indiano

[57] ABSTRACT

A support is provided for supporting a container, such as a plastic trashbag, which is generally incapable of supporting itself in an open, upright position. The support is formed from a unitary, sheet-like blank, which is scored in at least five places to form a series of at least five axially-extending, generally parallel fold lines. The at least five fold lines define at least six panels, including a first panel, a last panel, and at least four intermediate panels. Each of the panels include a top edge, a bottom edge, a first side edge portion, a second side edge portion, an interior surface, and an exterior surface. The at least six panels are hingedly connected along the at least five fold lines to place the at least six panels in a side-by-side relation. Staples are provided for securing the first side edge portion of the first side panel to the second side edge portion of the last panel. The panels and securing means are configured to permit the support to move between a storage position wherein the interior surfaces of each of the panels are disposed in generally parallel planes, and a use position wherein the panels form a generally endless, hollow tube having an open bottom and top, and being capable of supporting itself in an upright position. Also when in the use position, the support has an interior defined by the interior surfaces of the panels for receiving the container.

12 Claims, 1 Drawing Sheet

10
18
50
22

18
26
24
16
20
22
10

24
22
58
10
20
46
54
30
40
40
52
80
38
38
48
80
26
18
32
16

18
46
76
48
50
78
16
12
26
74
10
46
48
82

68
20
6
6
24
70
26
18
16
72
22

10

SUPPORT FOR A NON-SELF SUPPORTING CONTAINER

BACKGROUND OF THE INVENTION

The present invention relates to a support device, and more particularly to a support for supporting a container, such as a plastic trashbag, which is generally incapable of supporting itself in an open, upright position.

Recent years have seen a marked increase in the use of containers, such as plastic trashbags. Plastic trashbags are preferred by many persons due to their relatively low cost, their ability to hold large quantities of material, and their ease of disposal. Additionally, as it requires less time for a sanitation worker to place a plastic bag into a garbage truck than to empty a garbage can into a garbage truck, several communities have suggested or mandated the use of plastic trash bags for holding household refuse.

However, plastic trash bags have several drawbacks. One drawback is that plastic trashbags are generally incapable of supporting themselves in an open, upright position.

The inability to be self-supporting hampers the use of plastic trash bags. For example, in their unsupported state, the user must generally use one hand to hold the bag open while using the other hand to place the refuse in the bag. Often, the user is required to bend over to grab the bag to hold it open. Thus, it will be appreciated that the use of the bag would be greatly facilitated if the user were not forced to bend over to open the bag, and were able to have both hands free to pick up refuse and place it in bag. This problem can be especially annoying when undertaking tasks such as placing large quantities of leaves in a trashbag.

To overcome these difficulties, many users have placed plastic trashbags in a wide variety of supports. For example, many users will place a plastic trashbag in a conventional garbage container. Although a conventional garbage container does serve as a good support for a trashbag, several disadvantages exist with the use of conventional garbage containers. One disadvantage is that conventional garbage containers tend to be relatively expensive (when compared to the support of the instant invention). A second disadvantage is that the existence of a bottom on the traditional garbage container forces the user to separate the trashbag from the container by lifting the bag out of the garbage container. As can be appreciated, the weight of a fully-loaded trashbag can cause difficulty for many users.

One known device for overcoming these problems attendant to the use of a conventional garbage container to support a trashbag is the EASY BAGGER (tm) interior support, which is manufactured by WILMARC INC., of Indianapolis, Indiana 46205, the assignee of the instant application. The EASY BAGGER generally comprises a rectangular plastic sheet which can be disposed in the interior of a trashbag for supporting the trashbag. Although the EASY BAGGER liner represents a marked improvement over a conventional garbage container, room for improvement still exists.

One other difficulty with conventional garbage cans is that their generally rigid shape and bulk causes them to require a large amount of storage space to store. This storage space can be especially burdensome to someone such as a caterer who is required to transport a large number of containers from the caterer's place of business to the site of a job, and then return the containers back to its place of business.

It is therefore one object of the present invention to provide a generally inexpensive support for a non-self supporting container, which is reusable but disposable, and which facilitates the separation of the container from the trashbag it supports.

SUMMARY OF THE INVENTION

In accordance with the present invention, a support is provided for supporting a container, such as a plastic trashbag, which is generally incapable of supporting itself in an open, upright position. The support comprises a support having a plurality of panels including a first panel, a last panel, and at least two intermediate panels. Each of the panels includes a top edge, a bottom edge, a first side edge portion, a second side edge portion, an interior surface, and an exterior surface. Securing means are provided for securing the first side edge portion of the first panel to the second side edge portion of the last panel. Hinge means are provided for hinging the at least two intermediate panels to each other along the side edge portions of the at least two intermediate panels, and for hinging the at least two hingedly connected intermediate panels to the first panel and last panel along the side edge portions thereof. When the first panel, at least two intermediate panels, and the last panel are hingedly connected, the support can be moved between a storage position wherein the interior surfaces of each of the first panel, at least two intermediate panels, and last panels are disposed in generally parallel planes, and a use position wherein the panels form a generally endless tube capable of supporting itself in an upright position, and having an interior defined by the interior surfaces of the first panel, at least two intermediate panels, and last panel, for receiving the container.

Preferably, the at least two intermediate panels comprise at least four intermediate panels, and the hinge means hingedly connects all of the intermediate panels in a side-by-side relation along their respective edge portions. Further, a cut-out portion can be provided for serving as a handle.

Also in accordance with the present invention, a process is provided for forming a support for a container, such as a plastic bag, which is generally incapable of supporting itself in an open, upright position. The process comprises providing a generally rectangular, sheet-like blank. The sheet-like blank is scored in at least five places to form at least five generally parallel fold lines to define at least six panels. These six panels include a first panel, a last panel, and at least four intermediate panels. Each of the panels includes a top edge, a bottom edge, a first side edge portion, a second side edge portion, an interior surface, and an exterior surface. The panels are disposed in a side-by-side relation, with adjacent panels being hingedly connected at the fold lines. A cut-out portion is formed in at least two of the panels to serve as a handle for the support. The first panel and last panel are secured together to hingedly connect them, to form an endless support which is movable between a storage position wherein the interior surfaces of each of the first, at least four intermediate, and last panels are disposed in generally parallel planes, and a use position wherein the first panel, at least four intermediate panels, and last panel form a generally endless tube capable of supporting itself in an upright position.

One feature of the present invention is that, when in the use position, the support forms an endless tube which is open at both ends, and hence has no bottom. This feature has the advantage of facilitating the separation of the support from the trashbag it is supporting. The bottomless nature of the tube permits the user to either lift the bag out of the support, or alternately, lift the support out from around the trashbag.

Another feature of the instant invention is that the support comprises a series of hinged panels which permit the device to be moved between a collapsed "storage position," and a self-supporting "use position." This feature has the advantage of creating a device which is sufficiently compact to require little space when in the storage position. The space savings provided by the device is appreciated by individuals such as store owners who carry the item in their stores, users who store the item in their homes, and caterers who transport the devices to a job site. When in the use position, the self-supporting nature of the device facilitates the use of non-self supporting containers, such as trashbags.

It is also a feature of the present invention that the support can be formed from a unitary cardboard blank, having its ends (the side portions of the first and last panels) secured together. This feature has the advantage of enabling the device to be made inexpensively, with relatively little labor input. As can be appreciated, the inexpensive nature of the device makes it attractive to those, such a caterers and party hosts, who desire a container support for use on one occasion only.

A further feature of a preferred embodiment of the instant invention is that the device is comprised of a series of corrugated cardboard panels having a "radial" fluting extending generally perpendicular to the axis of the hinge means. This feature has the advantage of lending structural rigidity and strength to the support.

Additional features and advantages of the invention will become apparent to those skilled in the art upon consideration of the following detailed description of a preferred embodiment exemplifying the best mode of carrying out the invention as perceived presently.

BRIEF DESCRIPTION OF THE DRAWINGS

The detailed description particularly refers to the accompanying figures in which.

DETAILED DESCRIPTION OF THE INVENTION

Figures 1, 2, 3, 4, 5, 6:
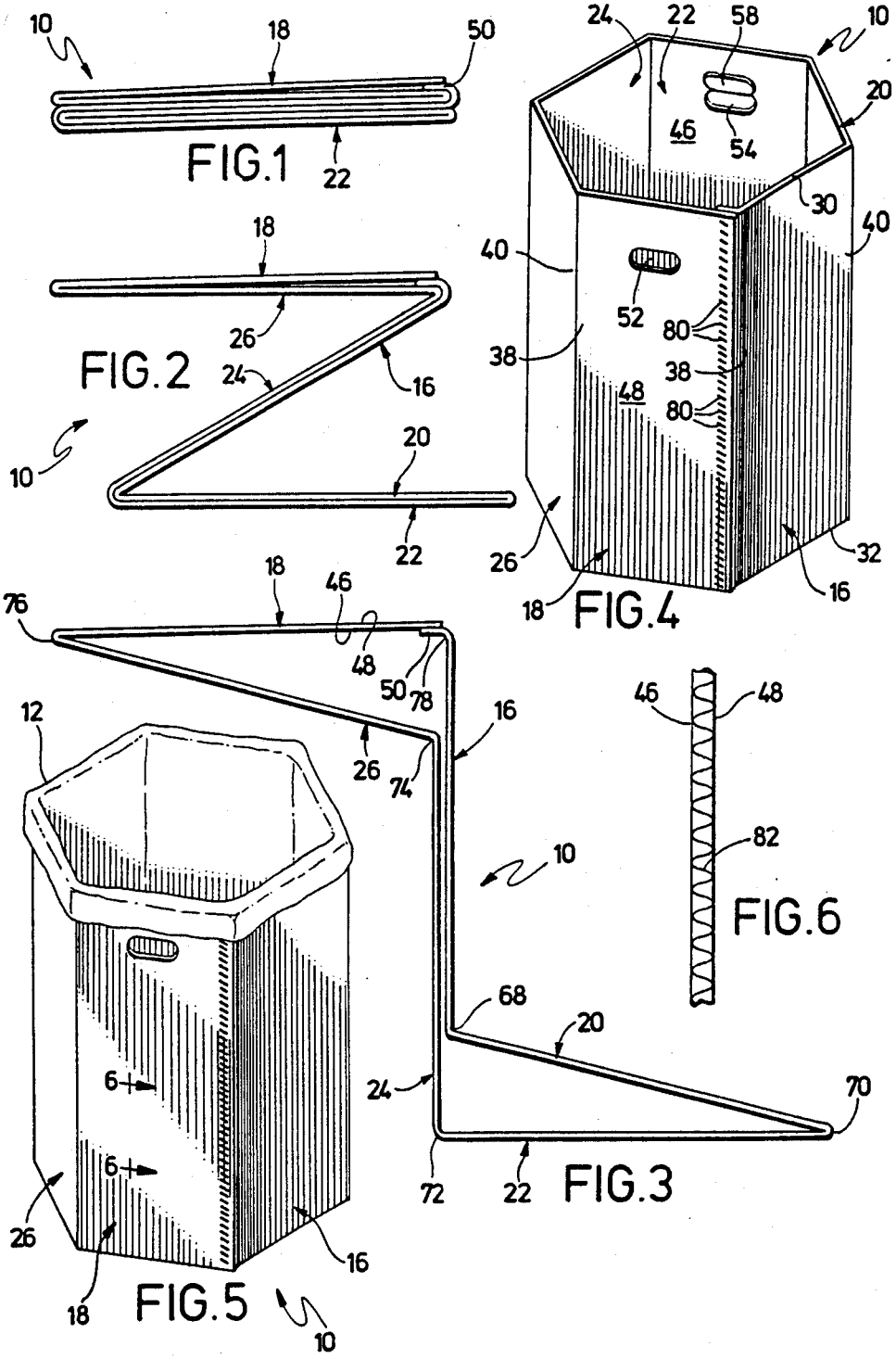
FIG. 1 is the bottom view of the invention shown in its "storage " position.
FIG. 2 is the bottom view of the instant invention shown in a partially-open position.
FIG. 3 is the bottom view of the invention shown in a partially-opened position.
FIG. 4 is a perspective view of the invention shown in its use position.
FIG. 5 is a perspective view of the invention shown in its use position, supporting a container.
FIG. 6 a sectional view taken along lines 6—6 of FIG. 5.

A support 10 of the present invention for supporting a container such as a plastic bag 12 which is incapable of supporting itself in an upright, open position is shown in the drawings. The support 10 is formed from a unitary cardboard blank (not shown), and includes a first panel 16, a last panel 18, a first intermediate panel 20, a second intermediate panel 22, a third intermediate panel 24, and a fourth intermediate panel 26. Each of the panels is generally rectangular in shape, and includes a top edge 30, a bottom edge 32, a first side edge portion 38, and a second side edge portion 40. Further, each panel also includes an interior surface 46 and an exterior surface 48. Preferably, the interior and exterior surfaces 46, 48 have a water-repellant coating (such as wax coating) placed thereon. The first panel 16 also includes a generally axially extending flap portion 50, which extends between the top edge 30 and the bottom edge 32 of the first panel 16 and is disposed adjacent to, and formed from the first side edge portion 38 of first panel 16.

In the preferred embodiment of the present invention, each of the panels 16, 17, 18, 20, 22, 24, 26 is generally rectangular in shape, has a generally similar width, and has a generally similar height. For example, in one model of the invention, each panel has a width of approximately ten inches (25.4 cm), and a height of approximately 25 inches (63.5 cm). Of course, it will be appreciated that the first panel 16 has a slightly greater width (approximately 11 inches) (27.94 cm), due to the presence of the flap portion 50.

At least two of the panels, such as last panel 18 and second intermediate panel 22, include cut-out portion 52, 54, respectively, for forming handles for lifting the device 10. The cut-out portions 52, 54, are formed by punching an incomplete hole in the respective panels to yield a handle flap 58. Preferably, the cut-out portions 52, 54 are formed in an opposed pair of panels, such as opposed pair 18, 22, pair 26, 20 or pair 16, 24.

Hinge means are provided for hingedly connecting the panels 16, 18, 20, 22, 24, 26 together in a side-by-side relation, along their respective side edge portions 38, 40. The hinge means comprises a series of six, generally parallel fold lines including first fold line 68 disposed between first panel 16 and first intermediate panel 20; second fold line 70 disposed between the first intermediate panel 20 and second intermediate panel 22; third fold line 72 disposed between second intermediate panel 22 and third intermediate panel 24; fourth fold line 74 disposed between third intermediate panel 24 and fourth intermediate panel 26; and fifth fold line 76 disposed between fourth intermediate panel 26 and last panel 18. Additionally, a sixth fold line 78 is formed between the flap portion 50 and the remainder of first panel 16.

Each fold line is generally parallel to all the other fold lines. Each fold line 68, 70, 72, 74, 76, 78 extends axially between the top edge 30 and bottom edge 32 of each panel, and is disposed adjacent to side edge portions 38, 40, of the panels 16, 18, 20, 22, 24, 26. The fold lines provide a hinged connection between adjacent panels, which permits the adjacent panels to move about the axes of the respective fold lines 68, 70, 72, 74, 76, 78.

Preferably, the fold lines are formed by scoring the unitary cardboard blank from which the support 10 is made. Fold lines 68 and 74 are formed by scoring the cardboard blank along the exterior surface 48 of the blank, and fold lines 70, 72, 76, 78 are formed by scoring the cardboard blank along the interior surface 46. Additionally, fold lines 72 and 78 should be "double scored" to provide a pocket for receiving the portions of the support 10 adjacent to fold lines 68 and 74 respectively, when the support 10 is placed in its storage position.

Securing means, such as staples 80 are provided for securing the second side edge portion 40 of last panel 18 to the flap portion 50 of first panel 16. Preferably, the exterior surface 48 of flap portion 50 is placed adjacent to the interior surface 46 of the second side edge portion 40 of last panel 18, so that the staples 80 can extend through the last panel 18 and the flap portion 50 to secure the last panel 18 to the first panel 16. When so secured, the support 10 comprises an endless, hexagonal tube, having no top cover or bottom plate.

The securing means and hinge means cooperate to permit the support 10 to move between a storage position (shown in FIG. 1) and a use position (shown in FIGS. 4 and 5).

Referring specifically now to FIG. 1, when the support 10 is placed in its storage position, the support comprises a compact structure wherein the interior surfaces 46 of each panel, and the exterior surfaces 48 of each panel are disposed in generally parallel planes. For example, in one model of the instant invention, the dimensions of the support 10, when in the storage position, are approximately 10.5 inches (26.67 cm) in width, 25 inches (63.5 cm) in height and approximately 0.75 inches (2.16 cm) in depth.

As will be appreciated, this compactness of structure can prove very useful in a wide variety of situations. For example, this compactness enhances the ability of a store owner to carry a large inventory of the devices on his store shelves, without requiring a large amount of space. Additionally, for those such a caterers, who must move their equipment from their office to a job site, the compactness of structure enables the caterer to place a large number of supports 10 in his vehicle to move the supports to the site of the function being catered. Further, the compactness of structure helps to alleviate spacial constraints faced by a homeowner who desires to store the support 10 between uses.

Referring now specifically to FIGS. 4 and 5, in the use position, the support 10 comprises an endless, hexagonally-shaped tube which is capable of supporting itself in an upright position on a flooring surface. The interior of the support 10 is defined by the interior surfaces 46 of the respective panels 16, 18, 20, 22, 24, 26, and is provided for receiving a non-self supporting container, such as a trashbag 12. The plastic trashbag 12 is received in the interior of the support 10, with the top edges 30 of the panels forming a lip over which the edges of the plastic trashbag 12 are draped to maintain the trashbag 12 on the support 10.

The device can be formed in the following manner. The support 10 starts out as a generally planar, cardboard blank which is comprised of corrugated cardboard having a test strength of approximately 200 pounds. In one model, the original blank is approximately 61 inches (154.94 cm) in width, by 25 inches (63.50 cm) in height. The blank is scored in six places to form the six, generally parallel fold lines 68, 70, 72, 74, 76, 78 to define the six panels, 16, 18, 20, 22, 24, 26 and flap portion 50. The panels are disposed in a side-by-side relation, with adjacent panels being hingedly connected together at the fold lines 68, 70, 72, 74, 76 and 78.

The cardboard blank is scored so that the fold lines 68, 70, 72, 74, 76, 78 extend generally axially, and are disposed generally perpendicularly to the direction along which the fluting 82 of the cardboard extends. This "radially extending fluting" 82 helps to add to the structural rigidity of the support 10. The cut-out portions 52, 54 are formed by die-cutting, in a conventional manner.

The flap portion 50 of the first panel 16 is then secured by staples 80 to the second side edge portion 40 of last panel 18, to form an endless support 10. The support 10 is then folded (as shown) sequentially in FIGS. 3, 2, and 1 to place the support 10 in the storage position, wherein it can be packaged for shipment to distributors, retailers, and consumers.

In use, the device 10 is removed from its packaging and moved from its storage position, as shown in FIG. 1, to its use position, as shown in FIG. 4. A plastic trashbag 12, is then placed in the interior of the support 10. The edges of the trash bag are draped over the top edges 30 of the panels. Refuse, trash and the like can then be placed into the interior of the trashbag 12. When the trashbag 12 is full, the edges of the trashbag 12 are then removed from their engagement with the top edge 30 of the support 10, and tied with an appropriate twist tie. The trashbag 12 can then be lifted out of the interior of the support 10. Alternately, the user can grab the handles formed by the cut-out portions 52, 54, and lift the support 10 over the trashbag to disengage the support 10 from the trashbag 12. For many users, this method of disengagement is preferable, due to the weight of the fully-loaded trashbag 12.

After the support 10 is lifted off the trashbag 12, the support 10 can then be moved back into its storage position (FIG. 1), secured in its storage position by a rubber band, or by placement back into its original package, and stored for future use.

Having described the invention in detail, and by reference to the preferred embodiments thereof, it will be apparent that modifications and variations are possible without departing from the scope of the invention as defined in the appended claims.

What is claimed is:

1. A device for supporting a container, such as as a plastic trash bag, which is generally incapable of supporting itself in an open, upright position, comprising an endless cardboard support having a plurality of panels including a first panel, a last panel, and four intermediate panels including first, second, third, and fourth intermediate panels, each of the panels including a top edge, a bottom edge, a first side edge portion, a second side edge portion, an interior surface, and an exterior surface, securing means for fixedly securing the first side edge portion of the first panel to the second side edge portion of the last panel, and hinge means for hingedly connecting the four intermediate panels to each other along the side edge portions of the four intermediate panels, and for hingedly connecting the hingedly connected intermediate panels to the first panel and last panel along the side edge portions thereof.

wherein when the first panel, four intermediate panels, and the last panel are hingedly connected, the support can be moved between a storage position wherein (a) the interior surface of each of the first panel, four intermediate panels, and last panels are disposed in generally parallel planes, (b) the exterior surface of the first panel and the first intermediate panel, and the exterior surfaces of the third and fourth intermediate panels are disposed in an opposed adjacent relation, and (c) the interior surfaces of the first panel and third intermediate panel, the interior surfaces of the first intermediate panel and second intermediate panel, and the interior surfaces of the first panel and the fourth intermediate panels are disposed in an opposed adjacent relation, and a use position wherein the panels form a generally endless tube capable of supporting itself in an upright position, and having an interior defined by the interior surfaces of the first panel, four intermediate panels, and last panel for receiving the container.

2. The support of claim 1 wherein at least two of the first panel, last panel, first intermediate panel, second intermediate panel, third intermediate panel and fourth intermediate panel includes a cut-out portion for serving as a handle for the support.

3. The support of claim 1 wherein the first side edge portion of the first panel includes a generally axially extending flap portion, and hinge means for hingedly connecting the first panel and the flap portion.

4. The support of claim 1 wherein the securing means fixedly secures the flap portion to the second side edge portion of the last panel.

5. The support of claim 4 wherein the flap portion includes an exterior surface and an interior surface, the securing means comprises a plurality of staples, and, wherein the exterior surface of the flap portion is placed in an adjacent, opposed relation to the interior surface of the last panel to permit the staples to extend through the flap portion and last panel.

6. The support of claim 1 wherein the support comprises a corrugated cardboard support having fluting extending generally perpendicular to the axis of the hinge means.

7. The support of claim 1 wherein said support member is formed from a unitary cardboard blank, and said hinge means are formed by scoring the cardboard blank to form a series of fold lines extending generally axially between the top and bottom edges of the first panel, four intermediate panels and the last panel.

8. The support of claim 7 wherein the interior and exterior surfaces of the first panel, the four intermediate panels and the last panel include a water repellant coating.

9. The support of claim 8 wherein at least two of the panels includes a cut-out portion for serving as a handle for said support.

10. A device for supporting a container, such as a plastic trash bag, which is generally incapable of supporting itself in an open, upright position comprising, a support formed from a unitary, sheet-like blank, having an interior surface and an exterior surface, the blank including at least a first, second, third, fourth, fifth, and sixth scoring to form a series of at least six axially-extending, generally parallel fold lines, including a first, second, third, fourth fifth and sixth fold line, the at least six fold lines, defining at least six panels, including a first panel, a last panel, and at least four intermediate panels, each of the panels including a top edge, a bottom edge, a first side edge portion, a second side edge portion, an interior surface, and an exterior surface, the at least six panels being hingedly connected along the at least six fold lines to place the at least six panels in a side-by-side relation, the first scoring being made on the exterior surface to permit the exterior surfaces of the first panel and one of the intermediate panels to be placed in an opposed, adjacent relation, the fourth scoring being made on the exterior surface to permit the exterior surfaces of two intermediate panels to be placed in an opposed adjacent relation, and the third and sixth scoring comprising double scorings made on the interior surface to permit the third scoring to interiorly receive the portion of the blank adjacent to the first fold line, and to permit the sixth scoring to interiorly receive the portion of the blank adjacent to the fourth fold line, and affixing means for permanently affixing the first side edge portion of the first panel to the second side edge portion of the last panel, the panels and affixing means being configured to permit the support to move between a storage position wherein the interior surfaces of each of the first panel, at least four intermediate panels, and last panel are disposed in generally parallel planes, and a use position wherein the panels form a generally endless, hollow tube having an open bottom and top and being capable of supporting itself in an upright position, and having an interior defined by the interior surfaces of the first panel, the at least four panels and the last panel, for receiving the container.

11. The support of claim 10 wherein at least two of the panels include a cut-out portion for serving as a handle, and the interior and exterior surfaces of each of the first panel, at least four intermediate panels, and last panel include a water repellant coating.

12. A process for forming a support for a container, such as a plastic trash bag, which is generally incapable of supporting itself in an upright position, the process comprising:

providing a generally rectangular, sheet-like blank having an interior surface and an exterior surface, scoring the blank on the exterior surface in at least two places to form first and fourth generally parallel fold lines, single scoring the blank in at least two places to form second and fifth generally parallel fold lines, the second and fifth parallel fold lines being generally parallel to the first and fourth fold lines, double scoring the blank on at least two places to form third and sixth generally parallel fold lines, the third and sixth fold lines being generally parallel to first and fourth fold lines, the first, second, third, fourth, fifth, and sixth fold lines defining six panels including a first panel, second panel, third panel, fourth panel, fifth panel, and sixth panel, and a flap portion, the panels and flap portion being disposed in a side by side relation, and hingedly connected together at the fold lines, permanently affixing together the flap portion and the first panel to hingedly coupled the first and sixth panel, to create an endless support movable between a storage position wherein the interior surfaces of each of the panels are disposed in a generally parallel plane, and the exterior surfaces of the first and second panels, and the exterior surfaces of the fourth and fifth panels are disposed in an opposed adjacent relation, and a use position wherein the panels form a generally endless tube capable of supporting itself in an upright position.

* * * * *

UNITED STATES PATENT AND TRADEMARK OFFICE

CERTIFICATE OF CORRECTION

PATENT NO. : 4,940,200

DATED : July 10, 1990

INVENTOR(S) : W. David Sawyer; Mark W. Sawyer

It is certified that error appears in the above-identified patent and that said Letters Patent is hereby corrected as shown below:

Column 3, Line 58; "FIG. 6 a" -- should be "FIG. 6 is a".

Column 6, Line 53; "thereof." -- should be "thereof" (no period).

Column 8, Line 56; "coupled" -- should be "couple".

Signed and Sealed this

Fifth Day of November, 1991

*Attest:*

HARRY F. MANBECK, JR.

*Attesting Officer*

*Commissioner of Patents and Trademarks*